US005716198A

United States Patent [19]

Hiltemann et al.

[11] Patent Number: 5,716,198

[45] Date of Patent: Feb. 10, 1998

[54] RADIAL PISTON PUMP

[75] Inventors: Ulrich Hiltemann, Wermelskirchen; Dieter Otto, Ennepetal, both of Germany

[73] Assignee: Luk Automobiltechnik GmbH & Co. KG, Germany

[21] Appl. No.: 648,229

[22] Filed: May 13, 1996

[30] Foreign Application Priority Data

May 13, 1995 [DE] Germany ..... 195 17 628.6

[51] Int. Cl.[6] ..... F04B 1/04

[52] U.S. Cl. ..... 417/273; 417/312

[58] Field of Search ..... 417/273, 312, 417/493, 498; 91/491

[56] References Cited

U.S. PATENT DOCUMENTS

| | | | |
|---|---|---|---|
| 1,115,397 | 10/1914 | Clawson | 91/491 |
| 3,067,728 | 12/1962 | Bordini | 91/491 |
| 4,747,761 | 5/1988 | Yumiyama et al. | 417/312 |
| 4,975,025 | 12/1990 | Yamamura et al. | 417/273 |
| 5,237,907 | 8/1993 | Pöschl | 91/491 |
| 5,482,442 | 1/1996 | Blair et al. | 417/273 |

FOREIGN PATENT DOCUMENTS

| | | |
|---|---|---|
| 1294813 | 8/1969 | Germany . |
| 1925306 | 9/1970 | Germany . |
| 2248518 | 11/1974 | Germany . |
| 4305791 | 1/1994 | Germany . |
| 966635 | 8/1964 | United Kingdom . |
| 1119849 | 9/1968 | United Kingdom . |
| 2277558 | 2/1994 | United Kingdom . |

OTHER PUBLICATIONS

European Search Report dated 2 Oct. 1996.

*Primary Examiner*—Timothy Thorpe
*Assistant Examiner*—Peter G. Korytnyk
*Attorney, Agent, or Firm*—Ostrolenk, Faber, Gerb, & Soffen, LLP

[57] ABSTRACT

A radial piston pump having a shaft which is mounted in a pump housing an eccentric in the shaft and a stationary piston ring surrounding the eccentric. The piston ring receives the pistons arranged in radial direction to the shaft and surrounding the eccentric. The piston ring is provided with bore holes that open toward the eccentric, for receiving the pistons. The bore holes are closed off at their ends facing away from the eccentric by respective closure plugs. The piston ring is surrounded by a portion of the pump housing, e.g., an annular wall part, so that a liquid filled chamber is defined at least between the closure plugs and the inner side of the portion of the pump housing.

16 Claims, 2 Drawing Sheets

RADIAL PISTON PUMP

BACKGROUND OF THE INVENTION

The present invention relates to a radial piston pump in which a piston ring contains several pistons in respective radial bores and the pumping is accomplished through an eccentric on the pump shaft moving the piston ring to shift the pistons in their holes and pump the liquid. The invention particularly concerns noise suppression in such a pump.

Radial piston pumps of this type are known. In particular, the invention concerns pumps whose delivery volumes are controlled by so-called inflow constriction or suction throttling. The purpose of such regulation is to reduce the power loss. But such regulation creates a vacuum on the suction side, so that cavitation occurs. This causes a relatively strong development of noise during operation of the pump. Such pumps also develop considerable noise because pressure pulsations and strong eddies are produced on the high-pressure side of the pump.

SUMMARY OF THE INVENTION

The object of the present invention is therefore to create a radial piston pump which operates relatively quietly. This object is achieved with such a pump by providing a portion of the pump housing to surround the piston ring with sufficient clearance as to provide a liquid filled, preferably not high pressure chamber between the portion of the pump housing and the closure plugs at the ends of the piston bores at that pressure chamber. The piston ring contains the pistons to move back and forth upon operation of the pump and the ring is surrounded by the pump housing to define a liquid filled chamber at least between the closure plugs which closes the bores for the pistons and the inner side of the annular portion of the pump housing. This chamber dampens the vibrations or noise coming from the closure plugs causing relatively quiet operation of the pump.

In a preferred embodiment of the radial piston pump, the liquid filled chamber is an annular chamber that completely surrounds the piston ring. Such an embodiment can be produced relatively economically.

Also, in the preferred embodiment of the radial piston pump, the liquid in the liquid filled chamber is under only slight pressure, if any, and is preferably connected with the suction or inlet side of the radial piston pump. Vibrations caused by the closure plugs and transmitted to the liquid are thus dampened in such a manner that vibrations in the pump housing are reduced to a minimum.

Further, in a preferred embodiment of the radial piston pump, the pressure outlet openings, through which liquid conveyed by the pistons emerges from the piston ring under high pressure, are closed off by a packing device which includes spring tongues. These tongues are light weight, so that vibrations upon operation of the pump and pressure pulsations upon delivery of the liquid are reduced to a minimum which reduces the noise.

Other objects and features of the radial piston pump are explained below with reference to the drawings.

DESCRIPTION OF A PREFERRED EMBODIMENT

Figure 1:
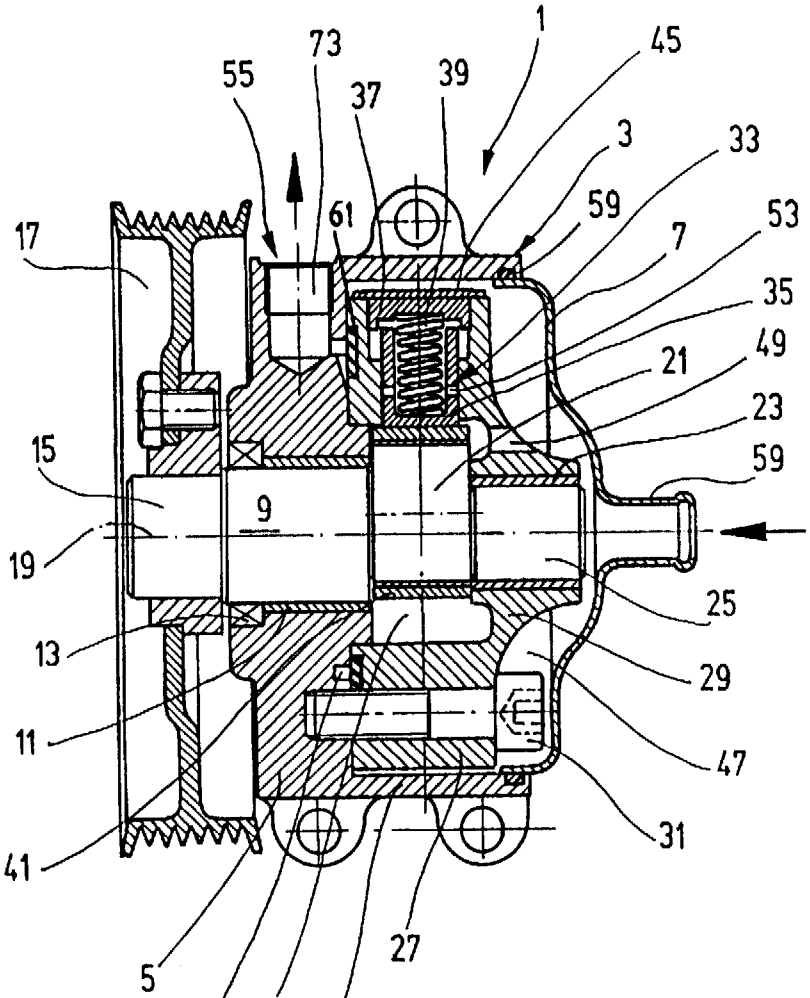
FIG. 1 is a longitudinal section through a radial piston pump according to the invention.

The radial piston pump 1 shown in FIG. 1 is preferably used in combination with internal combustion engine of a motor vehicle, and the pump is driven a suitable belt, not shown. The pump produces a stream of liquid which is used, for instance, for stabilizing the vehicle chassis, as well as for supporting the steering forces.

The pump 1 has a pump housing 3 which is comprised of two assembled parts, namely a base member 5 and a cover 7. The base member 5 is of solid construction. It supports a shaft 9, which is mounted by a bearing 11 in the base member 5. The shaft is provided with a packing 13 at the bottom of the base. A suitable drive wheel 17 is fixed for rotation on a stub shaft 15. The drive wheel drives the radial piston pump 1.

The shaft 9 includes an eccentric 21, which is eccentric to the axis of rotation 19 of the shaft. Beyond the eccentric, there is a shaft extension 25 which is mounted in a bearing and is arranged concentric to the other sections of the shaft 9.

A piston ring 27 extends over the axial region of the eccentric 21. The ring 27 is attached, fixed for rotation, to the base member 5 in a suitable manner, for instance by means of bolts 31. The ring 27 is preferably formed in a single part with a bearing attachment 29, which supports the bearing 23 and thus supports the shaft extension 25.

The ring 27 is provided with a plurality of bore holes 33, which each extend in a radial direction to the axis of rotation 19. The holes 33 are uniformly spaced around the ring. Pistons 35 of the radial piston pump 1 are arranged in the holes 33 and are displaceable in their radial directions. Each bore hole 33 is open on its end facing the eccentric 21 and is closed on the opposite end in pressure-tight manner by a closure plug 37. A coil spring 39 rests against the inner side of the closure plug and its opposite end lies against the head of the internally hollow piston 35 on which the spring exerts a pressing force. The piston head is pressed against the surface of the eccentric 21. A suitable bearing ring 41 can be provided around the eccentric.

The base member 5 includes an annular wall region 43, which surrounds the piston ring 27. The inside diameter of the annular wall region 43 is adapted to the outside diameter of the piston ring 27 so that a liquid filled chamber 45 is present inside the wall at least in the region of the closure plugs 37. In the embodiment shown, this chamber is developed as a continuous annular chamber which is filled with a liquid. This liquid is in fluid communication with the liquid drawn in by the radial piston pump 1 in the region 47 of the pump. The fluid communication is via a suction channel 49 leading to an annular, liquid filled, suction section 51, developed as annular chamber that surrounds the eccentric 21. The pistons 35 draw liquid out of the suction section 51 during operation of the pump 1. For this purpose, each piston includes a suction opening 53 arranged in its side wall. These openings 53 are placed in communication with the suction section 51 as each piston is moved by its coil spring against the eccentric and into its suction position, in which the head of the piston 35 is located so close to the axis of rotation 19 that the suction opening 53 is no longer closed by the wall of the bore hole 33. This is the condition of the bottom piston in FIG. 2.

Figure 3:
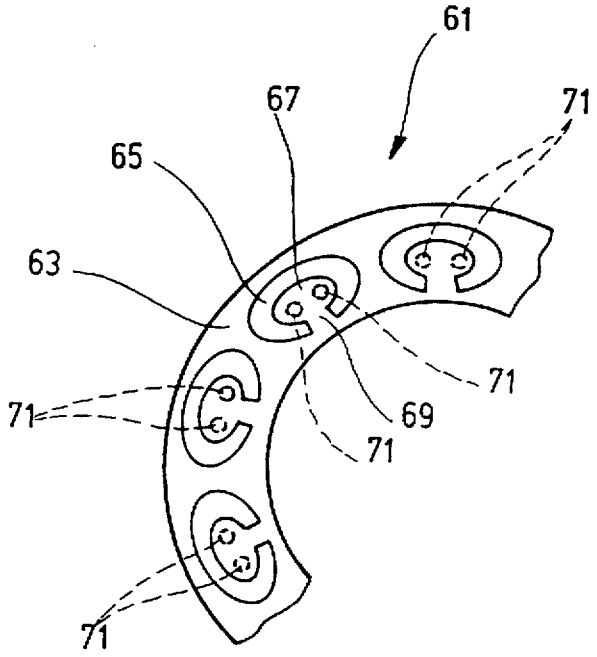
FIG. 3 is a diagrammatic showing of a region of the sealing ring.

In FIG. 1, the illustrated piston 33 is in its maximum outward position, in which its head is at the greatest distance from the axis of rotation 19. The liquid that was drawn in through the suction openings 53 is therefore expelled under high pressure into the high pressure region 55 of the pump by being conveyed into an annular pressure groove 57, which concentrically surrounds the axis of rotation 19. The liquid under pressure passes via openings (not shown) in the piston ring 27 out of the bore hole 33 into the pressure groove 57. The openings are closed by a suitable sealing device 61 (FIG. 3). The sealing device prevents the liquid, which is under high pressure, from flowing back out of the pressure groove 57 into the bore hole 33.

The cover 7 of the radial piston pump 1 is provided with a suction connection 59 through which the liquid, generally a hydraulic oil, drawn in by the radial piston pump 1 passes into the space closed off by the cover 7 and from there into the suction section 51.

Figure 2:
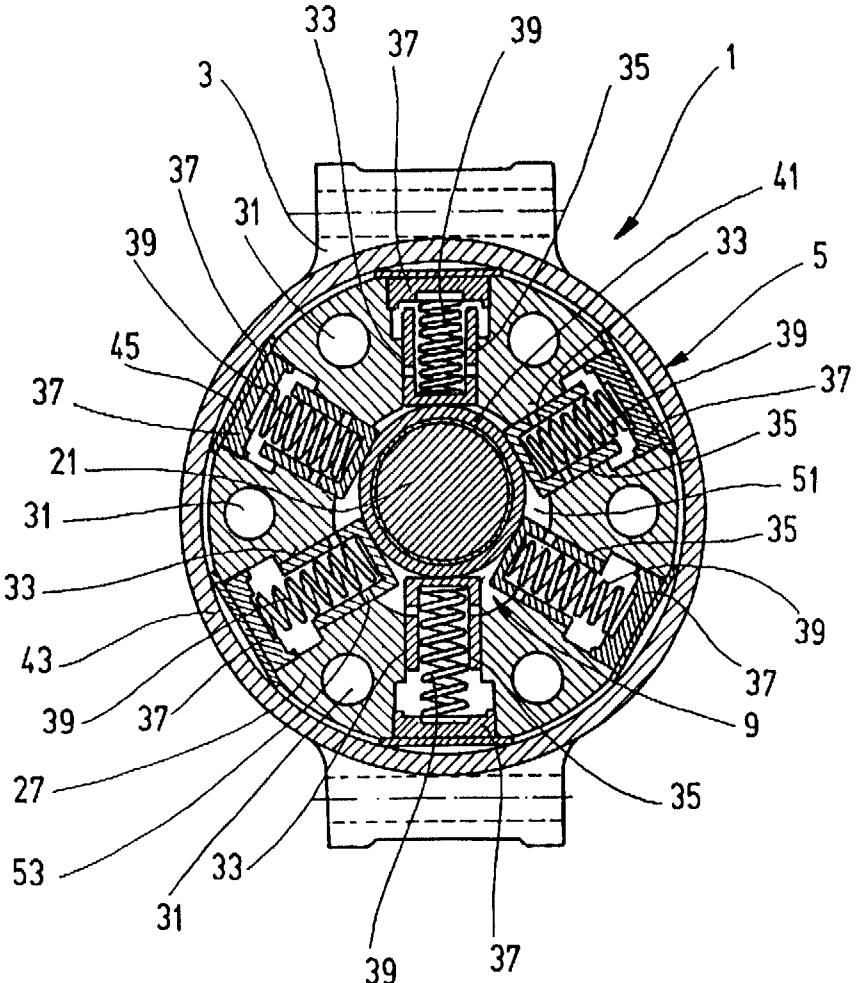
FIG. 2 is a cross section through the radial piston pump of FIG. 1 taken in the region of the piston ring.

The cross section of FIG. 2 shows an embodiment of the radial piston pump 1 having six pistons 35, which are guided in respective bore holes 33 in the piston ring 27. As explained above, the bore holes 33 are closed by respective closure plugs 37 on their ends facing away from the eccentric 21. The piston ring 27 has an outside diameter which is slightly smaller than the inside diameter of the annular wall region 43 of the base member 5 of the pump housing 3.

In FIG. 2, the top piston 53, in the 12-o'clock position, is shown pushed maximally into the bore hole 33, while the opposite bottom piston 35 is in its maximum extended position. The eccentric 21 can, for instance, turn in the clockwise direction, so that the piston 35 which lies clockwise and to the left of the lowermost piston is pushed somewhat further into its bore hole 33 than the lowermost piston. The next piston 35 in the clockwise direction is pushed even further into the bore hole, so that the liquid enclosed within the piston is under pressure. This pressure increases until the piston has reached the 12-o'clock position.

During pump operation, loud noises are produced, on the one hand, due to cavitation within the bore holes 33 and, on the other hand, due to high pressure pulsations which are caused by a very non-uniform volumetric flow. This is unavoidable with suction regulation. The noises are transmitted to the outside via the closure plugs 37, and then to the annular space 45, which completely surrounds the piston ring 27. Vibrations of the closure plugs 37, and the resulting noise coming from them, are damped by the liquid in the annular space 45, as that liquid is not under pressure. Since the annular wall region 43, which has the attachment points for the pump, is developed as a relatively solid part of the base member 5, it additionally dampens the noise coming from the pistons 35. It is therefore possible to make the cover 7 relatively light and with a thin wall, making it inexpensive.

As shown in FIG. 1, the cover 7 is arranged on the base member 5 via a packing 59, which seals off against low pressure or towards the outside. This merely requires another packing 13 on the shaft 9. This low pressure packing seals off from the outside or against low pressure in order to seal off the liquid present within the radial piston pump 1 from the outside. Liquid which emerges, for instance, from the inside of the bore holes 33 in the region of the closure plugs 37 does not pass into the open but instead passes into the space 45, and thus not into the suction region of the pump. The pressure groove 57 is tightly closed off by the piston ring 27, which is firmly applied against the base member 5. Between the base member 5 and the piston ring 27, there is an inner, high pressure packing, which does not seal from the outside. Should liquid emerge here, it does not pass outward into the open, but instead into the suction region of the pump. The construction of the radial piston pump 1 is therefore very simple and inexpensive with respect to the packings. With this embodiment, which uses no outside high pressure packing, i.e. packing sealing from the outside, but uses only two or three low pressure packings, provides a very high degree of security with respect to the tightness of the pump.

Parts in FIG. 2 which have already been described for FIG. 1, have been provided with the same reference numerals.

FIG. 3 shows a portion of the above described sealing device 61, which closes off the pressure outlet openings which debouch into the pressure groove 57.

The sealing device 61 comprises a flat plate. Its material, for instance metal, is preferably developed as a stamping. In the embodiment shown, a continuous support ring 63 is provided. It has several substantially C-shaped cutouts 65 around its circumference, and they are preferably stamped out. These cutouts 65 hold small sealing plates 67, which are of oval shape and are connected by respective narrow spring arm 69 to the support ring 63. Two pressure outlet openings 71 are associated here with each small sealing plate 67. It is also possible to alternatively make the sealing plates 67 round and to arrange them centrally over a pressure outlet opening 71.

The support ring 63 of the sealing device 61 is pressed against the surface into which the pressure outlet openings 71 debouch. In that way, the sealing plates 67 are pressed by the spring force of the spring arms 69 against the pressure outlet openings 71. This closes the openings 71 so that liquid which is under pressure cannot pass back into the pressure outlet openings 71. The sealing plates 67 therefore act like non-return valves.

The complete sealing device 61 is developed as a sheet metal part and can be flat. But, the spring arms 69 are preferably somewhat curved or else slightly bent off. If the sheet metal part 61 is now clamped between the base member 5 and the piston ring 27, the spring arms 69 which close the pressure outlet openings 71 are prestressed.

Since the material of the support ring 63 and thus of the sealing plates 67 can be very thin, the weight of the sealing plates is very slight. Therefore, relatively little momentum is required to lift the sealing plates 67 off the pressure outlet openings 71, so that very slight pressure pulsations occur upon operation of the radial piston pump.

It can also be seen that the liquid emerging from the pressure outlet openings 71 can emerge unimpeded and, with the sealing plates 67 raised, can emerge from the C-shaped recess 65. Thus, upon emergence of the liquid from the pressure outlet openings 71, very little eddying is induced. Therefore, the development of noise upon the emergence of the liquid which is under high pressure is minimized. Valve chatter, caused by a strong impact of the sealing element again the seat, which is very loud, for example, in the case of spherical-seat valves, does not occur here due to the very low weight.

This radial piston pump 1 is so developed that slight pressure pulsations are induced on the high pressure side and the development of noise as a result of eddying is minimized.

The principle of the construction of the radial piston pump 1 in FIG. 1 permits only a very small part of the pump housing 3 to be acted on by liquid which is under high pressure. The pressure groove 57 has very small dimensions. Residual pulsations in the region of the pressure groove 57 can therefore only transmit slight vibrations to the pump housing 3, so that, here also, the development of noise is reduced to a minimum.

As shown in FIG. 1, the pressure groove 57 is connected to an ordinary outlet 73, which, as indicated by an arrow, leads to a suitable load.

The above described radial piston pump 1 develops a very slight amount of noise even if it is used for conveying of liquid which is under a very high pressure, on the order of more than 100 bar, and even up to 200 bar.

It is essential that the region of the radial piston pump 1 where liquid under high pressure is present, for instance, at the piston ring 27, be completely covered within the pump housing 3 and that it also be surrounded by a liquid which is under slight pressure. Vibrations and noises from the piston ring 27 are, therefore, transmitted only to a very slight extent to the outside of the radial piston pump 1. The source of noise of the pump is also screened off because the piston ring 27 is completely surrounded by a solid wall region of the pump housing 3, namely the annular wall region 43. In addition, the forces necessary for attaching the piston ring within the pump housing 3 are introduced into the base member 5 so that no vibrations are transmitted to free standing regions of the housing, for instance, to the annular wall region 43.

Important also is that the construction of the radial piston pump 1 is simple and compact.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A radial piston pump comprising:

a pump housing;

a shaft mounted for rotation in the pump housing, the shaft having an eccentric that rotates with the shaft;

a stationary piston ring which surrounds the eccentric; the piston ring having a plurality of radial direction bore holes therein, each bore hole opening toward the eccentric;

a respective piston received in each bore hole; means bearing each piston against the eccentric, whereby each piston is moved inward and outward of its bore hole by the eccentric rotating past the piston;

each bore hole having an open end facing away from the eccentric;

a respective closure plug closing the open end of each bore hole;

the pump housing including a portion that surrounds the piston ring for defining a liquid filled chamber between the closure plugs and the inside of the portion of the pump housing which completely surrounds the circumference of the piston ring, the piston ring having a side and having pressure outlet openings from the bore holes through the side of the piston ring;

a sealing device for closing off the pressure outlet openings.

2. The radial piston pump of claim 1, further comprising the pump having a suction region communicating with each piston, and each piston having an entry opening located along the piston so that the entry opening is in fluid communication with the suction region when each piston is permitted to move inward by the eccentric; means placing the liquid within the chamber in communication with the suction region of the radial piston pump, such that the liquid in the chamber communicates with the suction region.

3. The radial piston pump of claim 1, wherein the pump housing is comprised of two parts.

4. The radial piston pump of claim 1, wherein the pump housing includes a base member for supporting the shaft and taking up the bearing forces of the shaft.

5. The radial piston pump of claim 4, wherein the piston ring is supported on the base member.

6. The radial piston pump of claim 1, wherein the portion of the pump housing comprises a base member having an annular wall which surrounds the piston ring.

7. The radial piston pump of claim 6, wherein the pump housing has a cover enclosing the piston ring and which is closed upon the annular wall so that there is no separation between the cover and the annular wall.

8. The radial piston pump of claim 1, wherein the sealing device includes sealing plates for closing off the pressure outlet openings.

9. The radial piston pump of claim 8, wherein the sealing device comprises a continuous support ring.

10. The radial piston pump of claim 9, further comprising spring arms connecting the small sealing plates with the support ring.

11. The radial piston pump according to claim 10, wherein the support ring is developed as a stamping.

12. A radial piston pump of claim 10, wherein the support ring is comprised of metal.

13. The radial piston pump of claim 1, further comprising a pressure groove in the pump housing for receiving the liquid under pressure which is conveyed by the radial piston pump.

14. The radial piston pump of claim 13, further comprising chambers in the pump housing communicating with the suction region of the radial piston pump; the pressure groove being smaller than the chambers.

15. The radial piston pump of claim 14, comprising all high pressure packings secured toward the outside of the pump housing by low pressure packings without a high pressure packing sealing off from the outside.

16. The radial piston pump of claim 15, further comprising two or three outwardly sealing packings for sealing off against low pressure.

* * * * *